United States Patent [19]

Levenson

[11] 4,377,426

[45] Mar. 22, 1983

[54] PYROTECHNIC PROCESS

[75] Inventor: Michael K. Levenson, Tempe, Ariz.

[73] Assignee: Pyrodex Corporation, Shawnee Mission, Kans.

[21] Appl. No.: 171,839

[22] Filed: Jul. 24, 1980

[51] Int. Cl.[3] ..... C06B 21/00

[52] U.S. Cl. ..... 149/109.6; 149/73; 149/82; 149/85; 264/3 C; 264/3 D

[58] Field of Search ..... 149/109.6, 73, 82, 85; 264/3 C, 3 D

[56] References Cited

U.S. PATENT DOCUMENTS 4,128,443 12/1978 Pawlak et al. ..... 149/71

*Primary Examiner*—Stephen J. Lechert, Jr.

[57] ABSTRACT

This application relates to the art of pyrotechnics and specifically concerns an improvement in the process for preparing granulated pyrotechnic compositions.

1 Claim, No Drawings

PYROTECHNIC PROCESS

BACKGROUND OF THE INVENTION

Pawlak and Levenson U.S. Pat. No. 4,128,443, describes pyrotechnic compositions and processes for preparing such compositions from inorganic oxidizing agents, aromatic carboxylic acid salts, water, and optional adjuvants consisting of binders, fuels, oxidants, ballistic modifiers, stabilizers and the like. Pawlak and Levenson teach that such compositions are conveniently prepared by blending the ingredients in a conventional rotary blender and subsequently drying the composition to their desired water content. Commercial production of such compositions proved difficult because of the inherent nature of the binder-water mixtures which caused the charge to be difficult to remove from the blender and to produce granules of pyrotechnic composition of widely varying sizes. As well known in the pyrotechnic art, a uniform particle size is essential for uniform burning rates.

The binders taught in U.S. Pat. No. 4,128,443 include dextrine, gum arabic, hydroxymethylcellulose, gum tragacanth, red gum and guar gum. None of the binders taught therein, when used alone, have been found to successfully overcome the aforesaid difficulties in producing uniform granulation.

Guar gum has been known as a binder and granulating agent for may years. For example, Hall and Bhalla, in U.S. Pat. No. 3,984,342, teach the use of aqueous solutions of various agglomerating agents, including guar, for producing agglomerates of sodium carbonate peroxide. In accordance with that process, a solution containing an agglomerating agent is sprayed on the tumbling particles of sodium carbonate peroxide.

DESCRIPTION OF THE INVENTION

In accordance with the present invention, it has been surprisingly found that the above-mentioned difficulties in production of granular pyrotechnic compositions containing water (i.e. poor release from blending equipment and poor uniformity of granulation size) are significantly reduced by using a small amount of guar gum in combination with a larger quantity of dextrine as a binder-granulating agent. The said combination has been found to produce uniform granulation unattainable by the use of either guar or dextrine alone.

Thus, in its broadest aspect, this invention provides a novel process for producing strong, uniform granules of a pyrotechnic composition consisting of a mixture of at least one inorganic oxidizing agent, an aromatic carboxylic acid salt, water, and optional adjuvants, which comprises: (1) mixing approximately 4.0 to 7.0 parts of dextrine, approximately 0.1 to 3.0 parts of guar gum and approximately 8 to 15 parts of water with 100 parts of said pyrotechnic composition, (2) intimately blending the resulting mixture under conditions of at least moderate shear until the granules are relatively uniform in size, and (3) drying the water-wet granules to the desired water content.

The pyrotechnic compositions prepared by the above-stated process have been found to be significantly easier to remove from the blending apparatus. Moreover, the granules are relatively strong and have a much more uniform size than were heretofore abtainable.

The process of this invention is carried out by incorporating the dextrine and gum in the pyrotechnic charge, and adding the appropriate amount of water by spraying onto the tumbling mixture. Any of the commercially available blenders can be used in this process such as ribbon blenders, signia-blade dough mixers, tumble blenders and the like, but I prefer a tumble blender which will impart at least moderate shear action to the tumbling charge.

Drying of the water wet charge is accomplished by standard drying means, i.e., by application of moderate heat, by passing dry air over the water wet granules, by applying vacuum to the blended materials, or a combination of any of the above.

EXAMPLE

Employing the procedure described in U.S. Pat. No. 4,128,443, a pyrotechnic composition was prepared from approximately 100 parts of blended pyrotechnic composition consisting of the following components:

| | parts |
|---|---|
| potassium nitrate | 45 |
| potassium perchlorate | 19 |
| hardwood charcoal | 6 |
| sulfur | 6 |
| sodium benzoate | 11 |
| dicyanamide | 6 |

To this mixture was added six parts of dextrine, 0.4 parts of guar gum, and 11.1 parts of water. The charge was blended in a tumble blender for 15 minutes and then air dried. The product was found to have a much more uniform granulation range than when dextrine alone was used as a binder.

In repeating the above procedure on a larger scale, it was found that optimum uniformity of granulation size was obtained with approximately two parts of guar gum to 6 parts of dextrine.

When the above described process was carried out using six parts of guar gum (and 0 parts of dextrine), it was found that at least 30 parts of water were required to achieve granulation, and the resulting granules were of inferior strength and poor uniformity.

I claim:

1. A process for producing strong, uniform granules of a pyrotechnic composition consisting of a mixture of at least one inorganic oxidizing agent, an aromatic carboxylic acid salt, water, and optional adjuvants, which comprises: (1) mixing approximately 4.0 to 7.0 parts of dextrin, approximately 0.1 to 3.0 parts of guar gum and approximately 8 to 15 parts of water with 100 parts of said pyrotechnic composition, (2) intimately blending the resulting mixture under conditions of at least moderate shear until the granules are relatively uniform in size, and (3) drying the water-wet granules to the desired water content.

* * * * *